US009643190B2

(12) United States Patent
Liu et al.

(10) Patent No.: US 9,643,190 B2
(45) Date of Patent: May 9, 2017

(54) SAFETY SHREDDER WITH BIN-FULL DEVICE AND TIME DELAY

(71) Applicant: Aurora Office Equipment Co., Ltd. Shanghai, Shanghai (CN)

(72) Inventors: Wei Liu, Shanghai (CN); Yingpeng Sun, Shanghai (CN); Yung Kang Tso, Shanghai (CN)

(73) Assignee: Aurora Office Equipment Co., Ltd. Shanghai (CN)

( * ) Notice: Subject to any disclaimer, the term of this patent is extended or adjusted under 35 U.S.C. 154(b) by 599 days.

(21) Appl. No.: 13/850,993

(22) Filed: Mar. 26, 2013

(65) Prior Publication Data

US 2014/0197258 A1 Jul. 17, 2014

(51) Int. Cl.

| | |
|---|---|
| ***B02C 23/04*** | (2006.01) |
| ***B02C 25/00*** | (2006.01) |
| ***B02C 18/00*** | (2006.01) |

(52) U.S. Cl.

CPC ..... *B02C 23/04* (2013.01); *B02C 18/0007* (2013.01); *B02C 25/00* (2013.01)

(58) Field of Classification Search

CPC ..... B02C 23/04; B02C 18/0007; B02C 2018/168; B02C 25/00; F16P 3/08

USPC ..... 241/36, 37.5, 100, 236

See application file for complete search history.

(56) References Cited

U.S. PATENT DOCUMENTS

| | | | | |
|---|---|---|---|---|
| 4,411,391 | A | 10/1983 | Crane | |
| 4,817,877 | A | 4/1989 | Itoh et al. | |
| 4,842,205 | A | 6/1989 | Araki et al. | |
| 5,044,270 | A | 9/1991 | Schwelling | |
| 5,969,310 | A | 10/1999 | Schwelling | |
| 6,065,696 | A | 5/2000 | Tsai | |
| 6,116,528 | A | 9/2000 | Schwelling | |
| 6,676,050 | B2 | 1/2004 | Chang | |
| 6,682,006 | B2 | 1/2004 | Lee | |
| 6,964,386 | B2 | 11/2005 | Ho | |
| 7,083,131 | B2 | 8/2006 | Ting | |
| 7,204,441 | B1 * | 4/2007 | Hartnett | B02C 18/0007 241/100 |
| 7,414,212 | B2 | 8/2008 | Huang | |

(Continued)

FOREIGN PATENT DOCUMENTS

| | | |
|---|---|---|
| CN | 200910055706 | 7/2009 |
| WO | WO2009/058225 | 5/2009 |

*Primary Examiner* — Faye Francis

(74) *Attorney, Agent, or Firm* — WHGC, P.L.C.; John F. O'Rourke

(57) ABSTRACT

A mechanical bin-full device for a paper shredder with a pressing plate, a contact switch, and a touching part. The pressing plate is installed at an outside portion of the shredder mechanical parts under the lower housing. One end of the pressing plate is pivots on the lower housing and the other end is free. The contact switch is fixed on the lower housing and a contact point is provided on the contact switch. The touching part is provided on the pressing plate, away from the mechanical parts. The lower housing has a through-hole under the contact point of the contact switch enabling the touching part to contact the contact point. The waste paper drives the pressing plate to turn around the joint between it and the lower housing, making the touching part touch the contact point of the contact switch and making the shredder power off.

20 Claims, 14 Drawing Sheets

(56) References Cited

U.S. PATENT DOCUMENTS

| | | | | |
|---|---|---|---|---|
| 7,584,913 | B1 * | 9/2009 | Lo | B02C 18/0007 241/100 |
| 7,661,613 | B1 * | 2/2010 | Pan | B02C 18/0007 241/100 |
| 7,731,112 | B2 * | 6/2010 | Matlin | B02C 18/0007 241/100 |
| 7,823,815 | B2 * | 11/2010 | Jensen | B02C 18/0007 241/100 |
| 2006/0054725 | A1 | 3/2006 | Matlin | |
| 2006/0219827 | A1 | 10/2006 | Matlin et al. | |
| 2007/0012808 | A1 | 1/2007 | Kao | |
| 2007/0034725 | A1 | 2/2007 | Duh | |
| 2007/0246581 | A1 | 10/2007 | Matlin et al. | |
| 2008/0006728 | A1 | 1/2008 | Zhang | |
| 2008/0105772 | A2 | 5/2008 | Matlin | |
| 2008/0156912 | A1 | 7/2008 | Huang | |
| 2008/0164351 | A1 | 7/2008 | Wang | |
| 2008/0169369 | A1 | 7/2008 | Wang | |
| 2010/0181400 | A1 * | 7/2010 | Davis | B02C 18/0007 241/100 |
| 2014/0263782 | A1 * | 9/2014 | Thurnell | B02C 18/2216 241/100 |
| 2015/0076260 | A1 * | 3/2015 | Tso | B02C 23/04 241/36 |

* cited by examiner

PRIOR ART

SAFETY SHREDDER WITH BIN-FULL DEVICE AND TIME DELAY

BACKGROUND

1. Field of the Invention

The present invention relates to paper shredder, in particular, to a mechanical bin-full device of paper shredder.

2. Background Art

The shredder presently is a machine that is commonly used to destroy confidential documents. Generally, the shredder comprises a paper-shredding device and a waste bin. A fully-filled waste bin makes it difficult to continue the paper shredding, and high-piled scraps easily damage the paper-full detection device. The existing paper-full detection devices chiefly comprise two types: the mechanical one and the electronic one. The electronic paper-full detection device is fairly expensive and unstable, while the currently existing mechanical paper-full detection device has the shortcomings of being complicated in structure and inflexible to use.

In view of energy saving and safety, the shredder is usually provided with a time-delay switch and a safety switch of power-off function when the shredder head is lifted, but normally these two switches are installed separately, thus increasing the number of parts for the shredder and the manufacturing cost.

Meanwhile, the existing paper-full devices are individually set, thus a simply structured and easily operated paper-full mechanism that is able to be combinatorially set with other devices, such as the safety switch or time-delay switch for the shredder, with the power-off protection function actuating upon machine/bin separation, is needed.

SUMMARY

An embodiment of a mechanical bin-full device for a paper shredder can include a pressing plate, a contact switch, and a touching part. The pressing plate can be installed at an outside portion of the shredder mechanical parts under the lower housing of the shredder. One end of the pressing plate can be pivotably connected to the lower housing and the other end can be free. The contact switch is fixed on the lower housing of the shredder and a contact point is provided on one side of the contact switch which is near the lower housing of shredder. The touching part is provided on one side of the pressing plate which is away from the mechanical parts of the shredder. The lower housing of the shredder is provided with a through-hole under the contact point of the contact switch enabling the touching part to contact the contact point of the contact switch. Under the driving of the paper waste in the paper waste bin of the shredder, the pressing plate turns around the joint between it and the shredder's lower housing, making the touching part installed on the pressing plate touch the contact point of the contact switch and making the shredder power off. The width of pressing plate is shorter than the length of the cutter shaft of the shredder. The cross section of the pressing plate is approximately arc-shaped, which backs to the mechanical parts of the shredder, and the touching part is installed in the inside of the arc-shaped pressing plate. Also, the pressing plate may have multiple holes. The pressing plate may be parallel to the cutter shaft for the mechanical parts of the shredder. The touching part is provided with a tip part used for touching the contact point of the contact switch. In general, the touching part can be installed perpendicular to the surface of the pressing plate, and may be a touching rod or a touching plate. The contact switch can be a micro-switch.

In another embodiment, a mechanical bin-full device for a paper shredder, can include a contact switch, a touching device, and a pushing device. The contact switch has a contact point that is installed on the lower housing of the shredder. The contact point is contacted when the shredder head is put into the waste bin so that the shredder is powered on. Conversely, the contact point is released when the shredder head separates from the waste bin, enabling the shredder to be powered off. The touching device can be installed on the lower housing of the shredder or the waste bin that can touch or depart from the contact point of the contact switch, thus enabling the shredder to be powered on or powered off, respectively. The pushing device has one end, which is pivotally installed under the lower housing of the shredder at the outer side of the mechanical parts of the shredder, and the other end of which is a free end. The pushing device can push the touching device while being pushed by the paper waste in the shredder waste bin, enabling the touching device to depart from the contact point of the contact switch. The pushing device can be a pressing plate, on which a touching element is equipped. The touching element can push the touching device while the paper waste in the shredder waste bin pushes the pressing plate to rotate, thus enabling the touching device to depart from the contact point of the contact switch. The pressing plate can be an arc shaped pressing plate, the cambered surface of which backs to the mechanical parts of the shredder, and the touching element is set inside the cambered surface of the arc-shaped pressing plate. The touching element can be a touching sheet, one end of which is connected to the plate surface of the arc-shaped pressing plate, and the other end of which has a tip part, which can push the touching device so that the touching device can depart from the contact point of the contact switch. The touching sheet is installed in a direction perpendicular to the plate surface of the arc-shaped pressing plate. In some embodiments, the width of the pressing plate is less than the length of the cutter shaft of the shredder, and the pressing plate has multiple holes.

The touching device can be a poke rod that can be installed by a support at the inner side of the shredder waste bin. The poke rod can be pivotally connected to the support that is fixed to the shredder waste bin. The support can be set with a first restriction member that ensures the poke rod to contact the contact point of the contact switch in the case that the shredder head is put into the waste bin. The first restriction member can be a limit bar that is transversely installed on the support. The poke rod has a vertical part, one side surface of which props up one end of the limit bar. The relative position of the limit bar and the vertical part is set to ensure the poke rod to contact the contact point of the contact switch in the case that the shredder head is put into the waste bin. The support is equipped with a second restriction member that is used for restricting the moving distance of the poke rod upon being pushed by the touching element of the pressing plate.

The second restriction member is a limit bar and is set to be parallel to the first restriction member. The touching device can be a poke rod which is installed on the lower housing of the shredder through axially connecting to a branch component that is pivotally connected to the lower housing of the shredder. The inner side of the shredder waste bin is set with a support that can prop up one end of the poke rod when a drawing-type waste bin of the shredder is pushed in, thus enabling it rotate to contact the contact point of the contact switch. The support can be set with a first restriction member that can prop up one end of the poke rod when the drawing-type waste bin of the shredder is pushed in, thus enabling the support rotate to contact the contact point of the contact switch. The support can be equipped with a second restriction member that is used for restricting the moving distance of the poke rod upon being pushed by the touching element of the pressing plate.

The touching device can be a connecting rod connected to the lower housing of the shredder, and can move forward and backward. The connecting rod is set with a first end and a second end. The second end is equipped with an elastic element. The shredder waste bin is set with bars in the place corresponding to the position of the second end of the connecting rod. This elastic element enables the connecting rod to contact the contact point of the contact switch in the pushing of the bars set on the shredder waste bin. A convex part is disposed under the connecting rod, which can be pushed by the pushing device when it is pushed by the paper waste inside the shredder waste bin, thus enabling the first end of the connecting rod to depart from the contact point of the contact switch.

The lower housing of the shredder can set with a connecting rod holder, and the connecting rod passes through the connecting rod holder, which has two long shaped slots correspondingly to the both sides of the connecting rod, according to the long shaped slots. The connecting rod is set with two columnar convex portions that could be respectively set in each long shaped slot and can slide in it. The connecting rod holder generally includes two identical components located correspondingly to the both sides of the connecting rod, the long shaped slot is respectively set on the two components. The connecting rod is disposed with a restriction convex portion. The elastic element is a spring, one end of which props up the connecting rod holder and the other end of which props up the restriction convex portion.

Yet another embodiment of the present invention provides a time-delay mechanism of shredder integrated with a safety switch of power-off function, responsive to the lifting of the shredder head, having a time-delay switch body, in which the time-delay switch body can be provided with a forced rod. The paper waste bin of the shredder is provided with a support rib corresponding to the forced rod. One end of the forced rod is connected to the time-delay switch body through pivoting connection and the other end is connected to the support rib by means of touch. When the shredder head is put into the waste bin, under the driving of the support rib, the forced rod can drive the time-delay switch body to rotate and leave it in the contact state with the paper entrance.

The time-delay mechanism also includes a contact component with the paper entrance, which includes a contact part at paper inlet, a connecting rod, and a push button. Two ends of the connecting rod are fixed respectively to the contact part at paper inlet and the push button, and the push button can drive the time-delay switch body during entering of paper and make it closed. The mechanism also includes a time-delay component, which includes a cam and a gear; the cam and the gear rotate synchronously in the same direction, and the gear is engaged with the cutter shaft gear of the shredder through a reduction gear. The time-delay switch body includes a contact piece, which rotates and joints to the time-delay switch body and makes the time-delay switch body closed, and the contact piece revolves and deviates from the time-delay switch body and makes it open. The forced rod is provided with a ring-like assembly at the end where it is connected to the support rib by means of touch; the ring-like assembly is installed on a hollow cylinder set at the lower housing of the shredder and its tail end stretches into the cavity of the hollow cylinder.

DESCRIPTION OF THE DRAWINGS

Embodiments of the present invention disclosed herein are illustrated by way of example, and are not limited by the accompanying figures, in which like references indicate similar elements, and in which.

Skilled artisans can appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention. In the figures, like numbers correspond to like elements.

DETAILED DESCRIPTIONS OF THE EMBODIMENTS

Below is an explanation of technical protocols for this invention through selected embodiments, but the following embodiments cannot limit the scope of protection of this invention.

Example Embodiment 1

Figure 1:
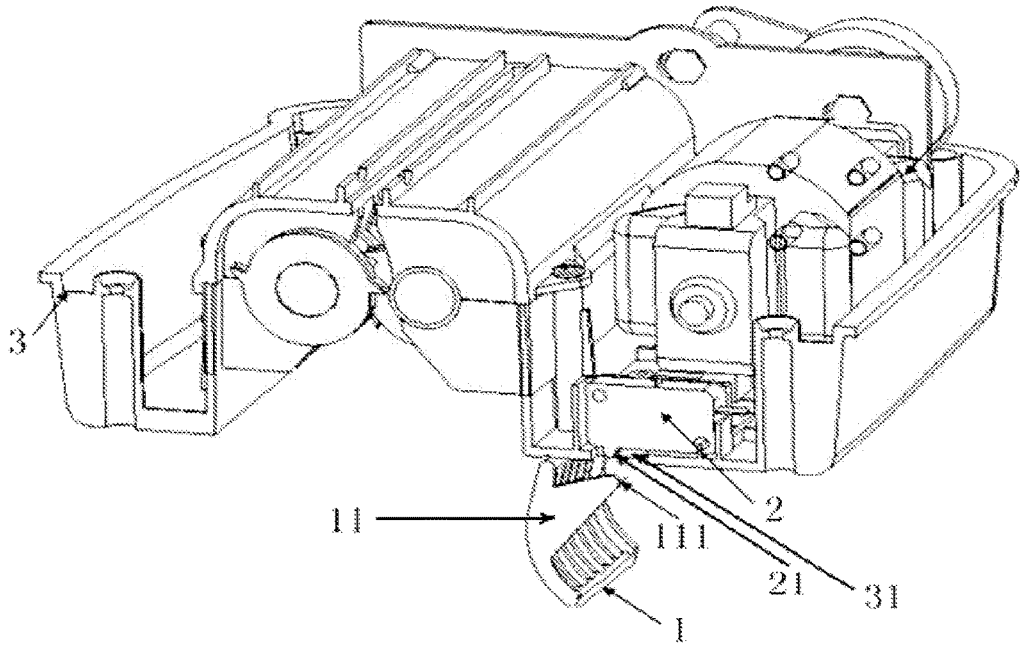
FIG. 1 is the cross-section view for the mechanical bin-full device of paper shredder in an embodiment, according to the teachings of the present invention.

In FIG. 1, the mechanical bin-full device of a paper shredder in this embodiment includes a pressing plate 1, a contact switch 2, and a touching part, which can be touching plate 11. Pressing plate 1 can be installed at the outside of the mechanical parts of the shredder under the lower housing 3 of the shredder, and parallel to the cutter shaft of the mechanical parts of the shredder, one end of which is connected to the lower housing 3 of the shredder through pivoting connection, such as rotation shaft, and the other end can freely swing. In other embodiments of the present invention, the pressing plate may be not parallel to the cutter shaft of the shredder. It can present a smaller, more acute, angle with the cutter shaft of the shredder.

A contact switch 2, fixed on the lower housing 3 of the shredder, and a contact point 21 is provided on one side of the contact switch 2 which is near the lower housing 3 of the shredder; the contact switch 2 is a micro-switch in this embodiment. A touching part is provided on one side of the pressing plate 1 which is away from the mechanical parts of the shredder, and in this embodiment, the touching part is installed perpendicular to the surface of the pressing plate 1; preferentially, in this embodiment, the touching part is a touching plate 11, which is provided with a tip part 111 which is used to touch the contact point 21 of the contact switch 2. The lower housing 3 of the shredder is provided with a through-hole 31 under the contact point 21 of the contact switch 2, enabling the touching plate 11 to touch the contact point 21 of contact switch 2, and under the driving of paper waste cumulated in the paper waste bin of the shredder, the pressing plate 1 turns around the rotation shaft, making the touching plate 11 installed on the pressing plate 1 touch the contact point 21 of contact switch 2 and making the shredder power off and stop running. In this embodiment, the cross section of the pressing plate 1 can be arc-shaped, which backs to the mechanical parts of the shredder, and the touching plate 11 can be installed in the inside of the arc-shaped pressing plate 1. In addition, in this embodiment, the pressing plate 1 has multiple holes, which can be arranged evenly. In this embodiment, these holes are long holes and in other embodiments they also can be round holes or any other suitable holes of any shape. In this embodiment, the width of pressing plate 1 can be shorter than the length of the cutter shaft of shredder, for example, its width can be from about ⅕ to about ⅓ of the length of the cutter shaft of shredder, and typically the pressing plate 1 can be installed in a position close to the middle. That the width of pressing plate is shorter than the length of the cutter shaft of shredder not only saves the material and makes it more portable. This configuration makes the pressing plate easily uplifted by the shredded paper as paper accumulates. It also reduces the probability of the pressing plate being damaged in the transportation process. When the pressing plate is set at the middle, the sensitivity of the paper shredder mechanical bin-full device is increased.

Figure 2A:
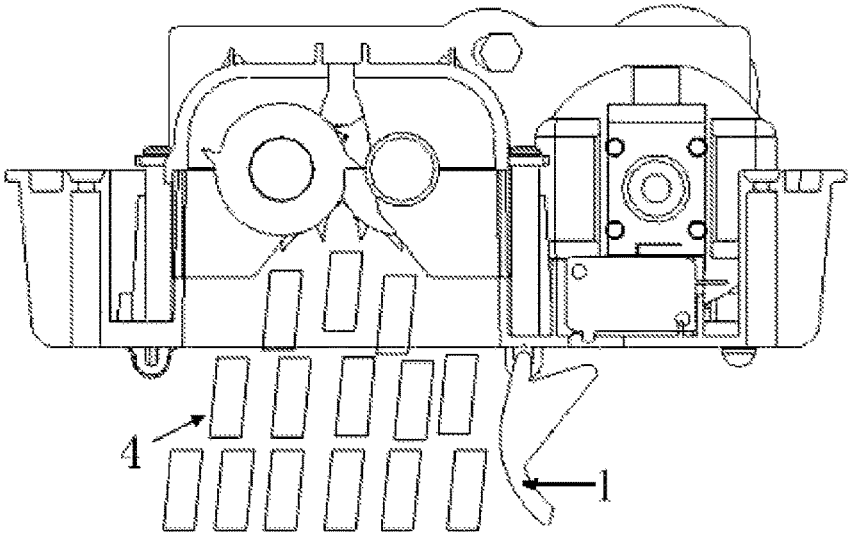
FIG. 2A and FIG. 2B are cross-sectional diagrams for a paper shredder mechanical bin-full device in a first and a second embodiment, according to the teachings of the present invention.
Figure 2B:
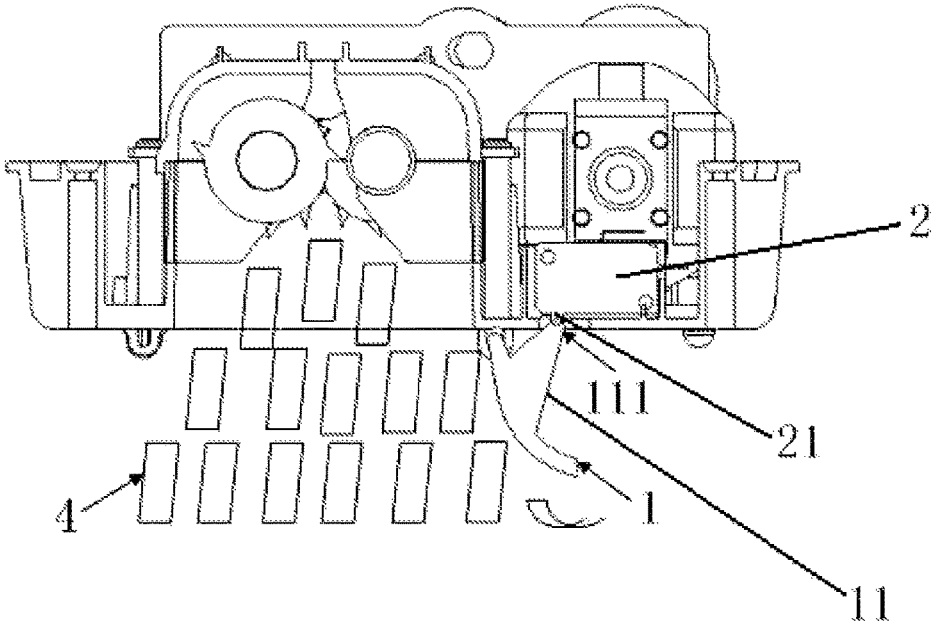
Figure 3:
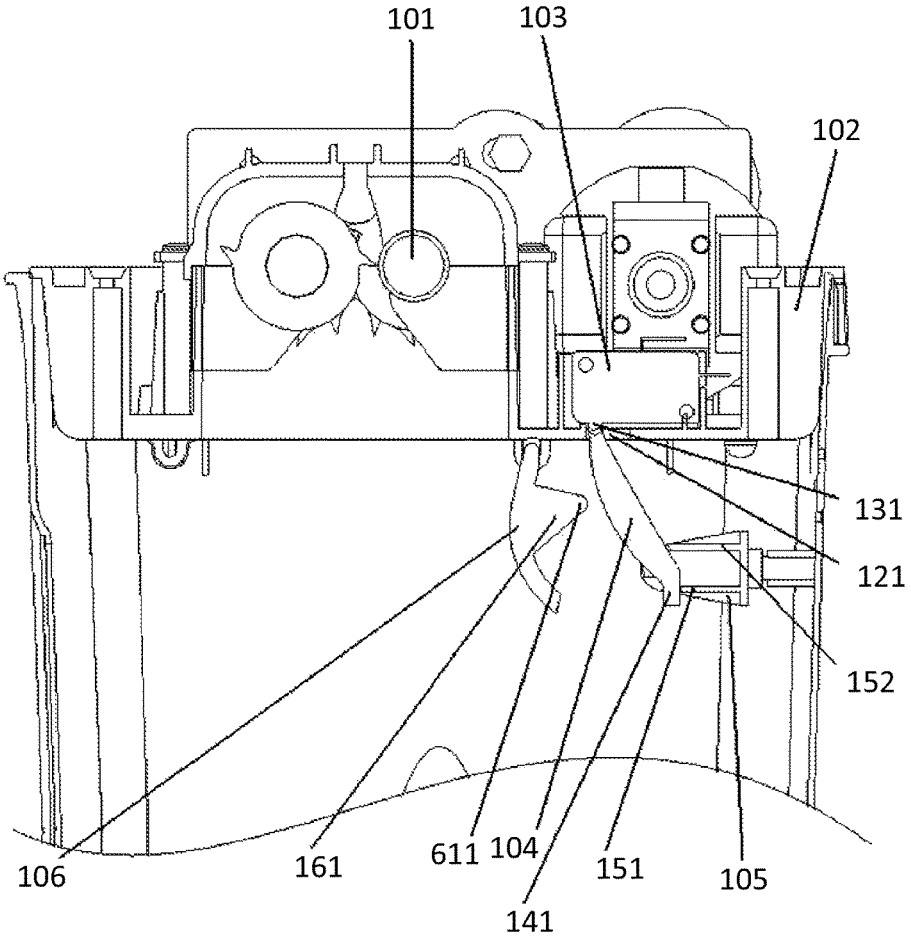
FIG. 3 is a cross-sectional diagram of a third embodiment of a mechanical shredder bin-full device, according to the teachings of the present invention.
Figure 4:
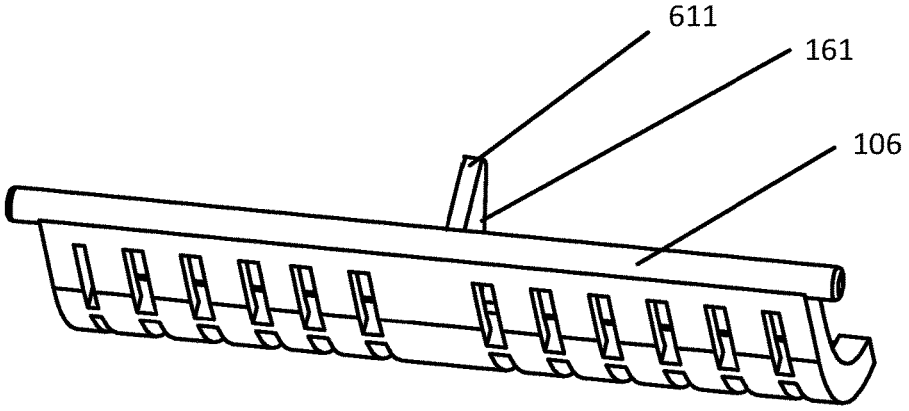
FIG. 4 is a perspective drawing of an arc-shaped pressing plate as described for the third embodiment, according to the teachings of the present invention.

Referring to FIG. 2A, when the paper shredder begins to run, the shredded paper waste 4 are minimal and the pressing plate 1 generally is not pressed, thus allowing the shredder to continually work. During shredding, shredded paper waste 4 is increased. When waste 4 reaches a certain volume, shredded paper waste 4 can drive the pressing plate 1, making the pressing plate 1 turn along the connecting shaft of the pressing plate 1 and the lower housing 3 of shredder. As the height of shredded paper waste 4 increases, it continues to push forward the pressing plate 1, making the tip part 111 of the touching plate 11 on the pressing plate 1 rise until the tip part 111 touches the contact point 21 of contact switch 2, shown in FIG. 2B, which makes the shredder power turn off and the shredder stop running. At that time, the user can clear away the shredded paper in the paper waste bin, and thereafter, because there is no pushing force of shredded paper waste, the pressing plate 1 will return and fall to its natural status, ready for the next cycle of paper shredding.

Example Embodiment 2

The difference of this embodiment from example Embodiment 1 is that the touching part installed on the pressing plate is a touching rod.

Example Embodiment 3

Figure 5:
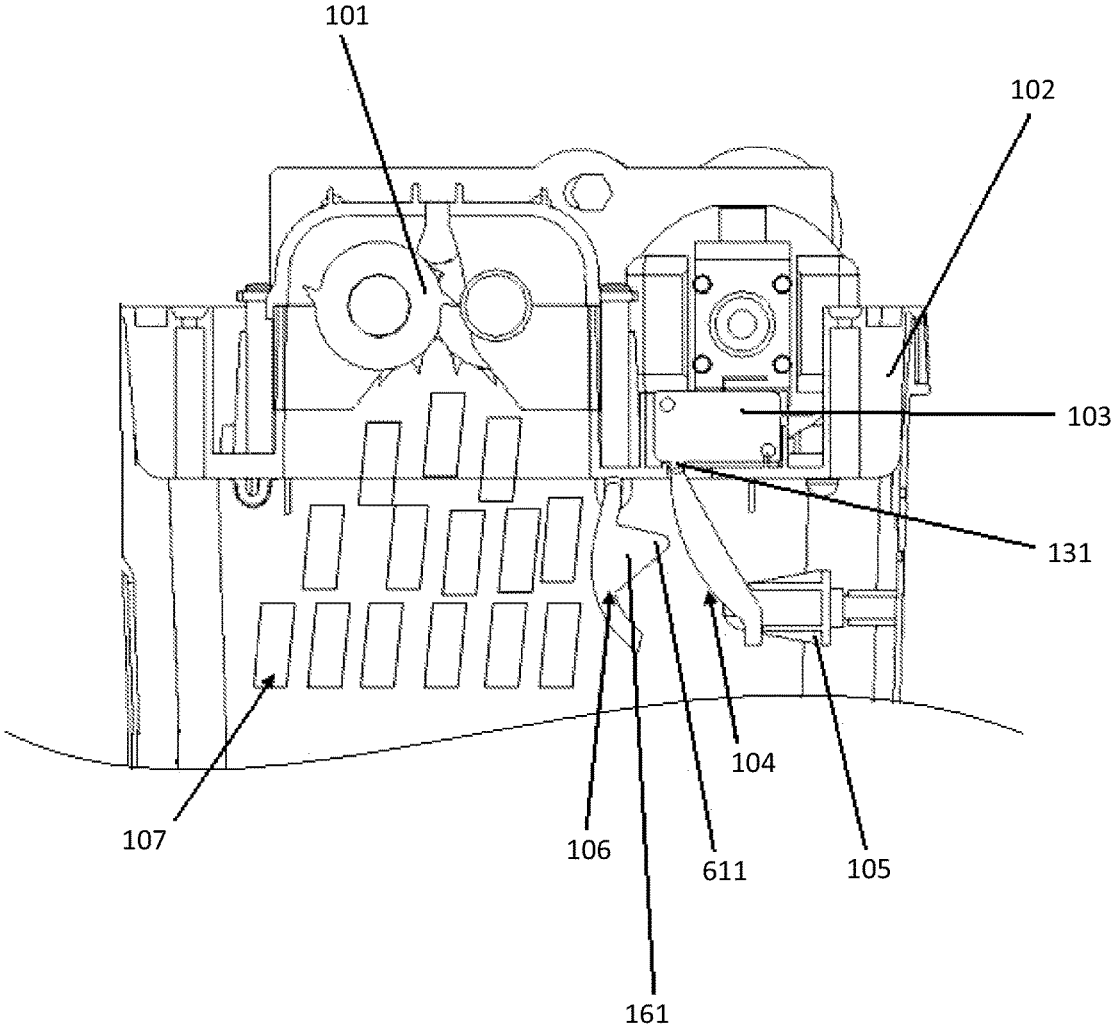
FIG. 5 and FIG. 6 are cross-sectional drawings of the shredder mechanical bin-full device of the third embodiment, according to the teachings of the present invention.
Figure 6:
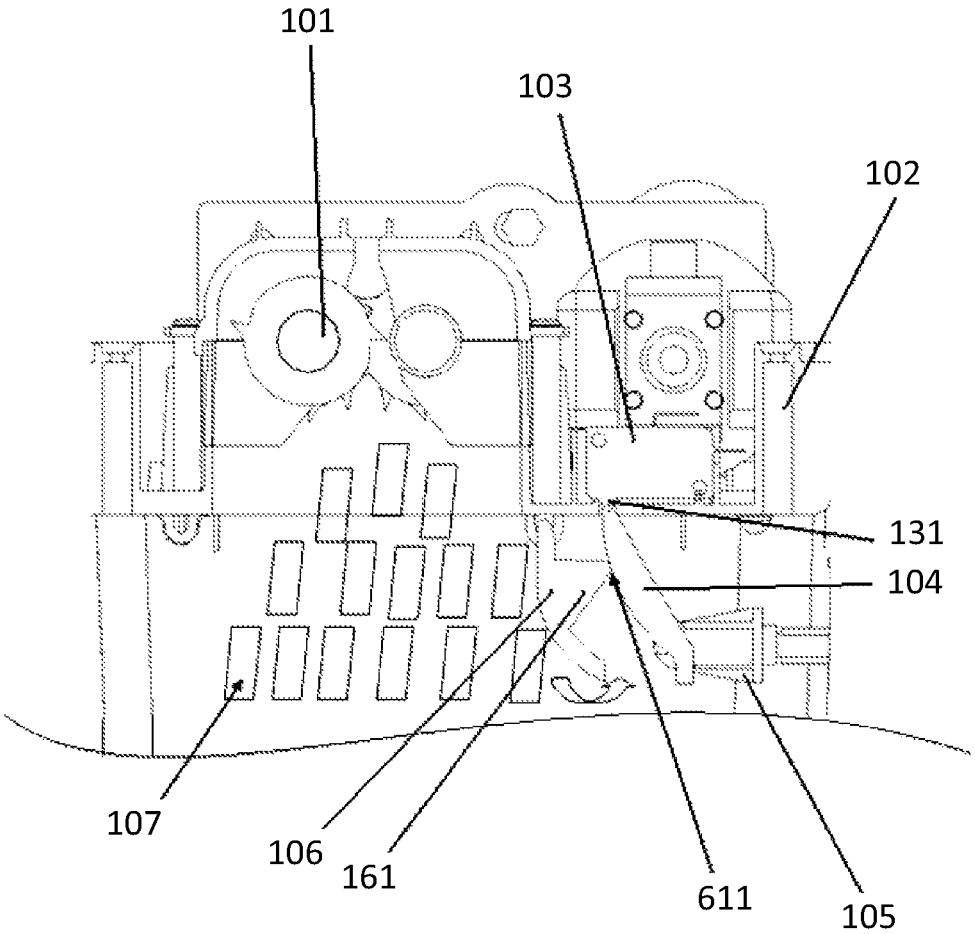
Figure 7:
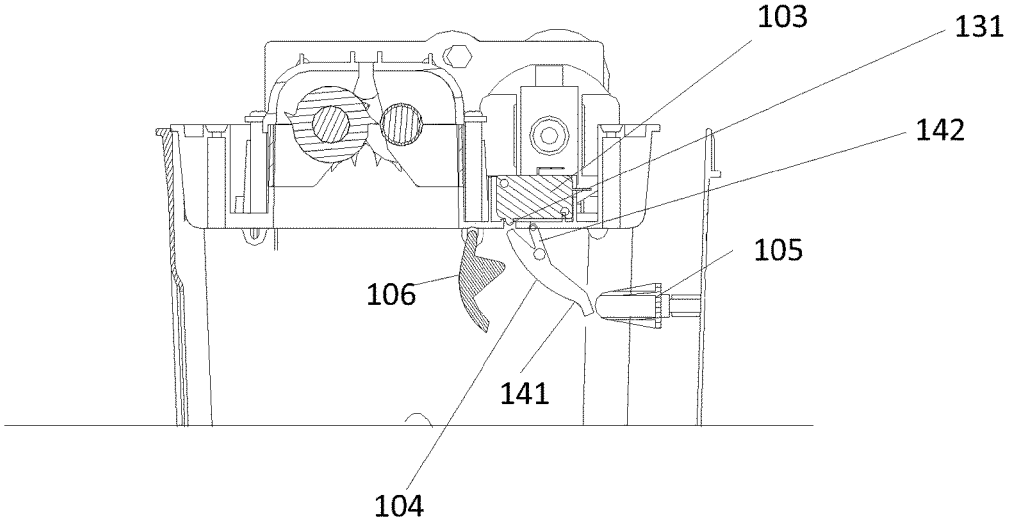
FIG. 7 and FIG. 8 are cross-sectional drawings of another shredder mechanical bin-full device implementation as illustrated in a third embodiment, according to the teachings of the present invention.
Figure 8:
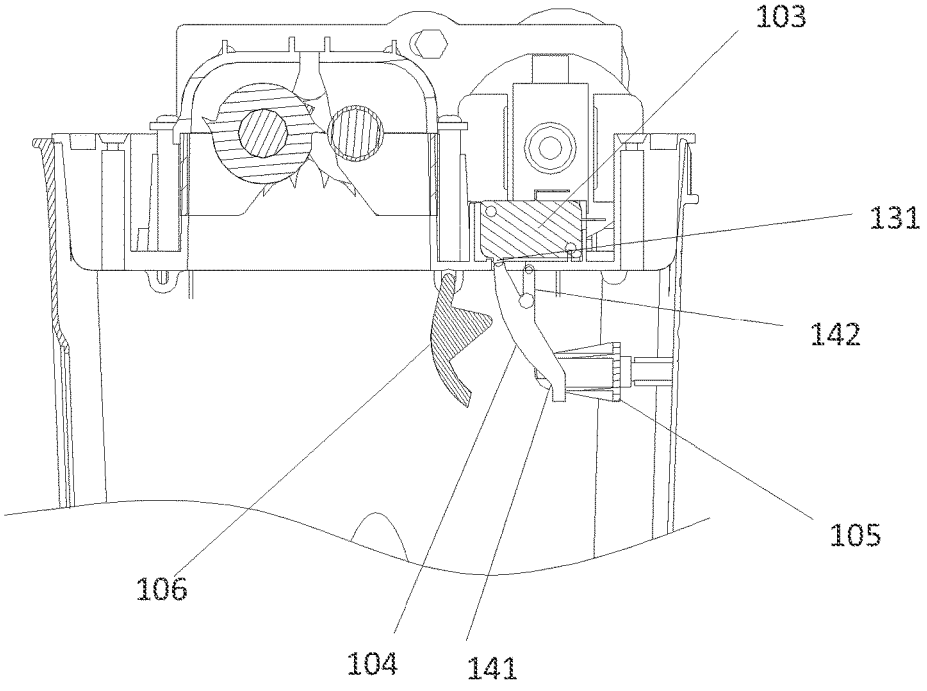

As shown in FIG. 3-6, the shredder in this embodiment includes the mechanical parts of the shredder 101, the lower housing 102 of the shredder, as well as the shredder mechanical bin-full device. FIG. 5 and FIG. 6 are cross-sectional drawings of the application processes of the paper-full detection functions by the shredder mechanical bin-full device. FIG. 7 and FIG. 8 are drawings of the structure by another mechanical bin-full device of shredder and on the application processes of the paper-full detection functions by another implementation of a shredder mechanical bin-full device.

The mechanical bin-full device of this embodiment chiefly consists of a contact switch, a touching device, and a pushing device. The contact switch, which is a safety switch 103 in this embodiment, may be fixedly installed on the lower housing of the shredder 102. The safety switch 103 is equipped with a contact point 131 that is to be contacted when the shredder head is put into the waste bin so that the shredder is powered on to function. When the shredder head separates from the waste bin, the contact point 131 of the safety switch 103 is released, thus enabling the shredder to be powered off. Whether the contact point 131 is triggered or not is used by the safety switch 103 to control the power-on or power-off for the shredder.

A touching device, which is a poke rod 104 in this embodiment, can contact or depart from the contact point 131 of the safety switch 103, thus enabling the shredder to be powered on or powered off, detailing in this embodiment as follows: the lower housing 102 of the shredder is set with a through hole 121 in the corresponding position under the contact point 131 of the safety switch 103. One end of the poke rod 104 passes through the through hole 121, ensuring the contact point 131 of the safety switch 103 to be contacted or released (e.g. released by the poke rod being pushed to move). The other end of the poke rod 104 is installed by a support 105 at the inner side of the shredder waste bin, wherein the support 105 can either be detachably mounted to the inner side of the shredder waste bin, or may be nondetachably fixed to the inner side of the shredder waste bin, or be integrally molded by injection along with the shredder waste bin. The poke rod 104 is pivotally connected to the support 105 through a rotation axis and it can rotate around the support 105 within a definitive scope.

The rotating scope of the poke rod 104 is limited by a first restriction member and a second restriction member placed on the support 105. In this embodiment, both the first restriction member and the second restriction member are limit bars, marked as the limit bar 151 and the limit bar 152. The limit bar 151 is transversely installed on the support 105. The poke rod 104 has a vertical part 141, one side surface of which is propped up one end of the limit bar 151. The relative position of the limit bar 151 and the vertical part 141 is set to ensure that the poke rod 104 can touch the contact point 131 of the contact switch 103 when the shredder is in the normal working condition, and preventing the poke rod 104 from suffering the deviation from the position of the contact point 131 that is incurred due to its downward rotation by action of gravity. The limit bar 152 is used for restricting the moving distance of the poke rod 104 from the contact point 131 of the safety switch 103 upon the poke rod 104 being pushed, and set parallel to the limit bar 151. Certainly, the limit bar 151 and the limit bar 152 are not necessarily set parallel to each other, their setup manners can utilize any other ones that are suitable to play the same roles. Moreover, the limit bar 152 is not necessarily set components but optional. This is illustrated only for explanation, but not for definition.

The pushing device, which can be an arc-shaped pressing plate 106 in this embodiment, one end of which is pivotally installed through a rotation axis under the lower housing of the shredder 102 at the outer side of the mechanical parts of the shredder 101, and the other end of which is a free end. The cambered surface of arc-shaped pressing plate 106 backs to the mechanical parts of the shredder 101, and the pressing plate 106 is equipped with a touching element, which is a touching sheet 161 in this embodiment. The touching sheet 161 is installed in the direction perpendicular to the plate surface of the arc-shaped pressing plate 106, wherein one end of the touching sheet 161 is connected to the plate surface of the arc-shaped pressing plate 106, and the other end has a tip part 611 that can push the poke rod 104 when the paper waste inside the shredder waste bin pushes the arc-shaped pressing plate 106 to rotate, enabling the poke rod 104 to depart from the contact point 131 of the safety switch 103.

Typically, the width of the arc-shaped pressing plate 106 is less than the length of the cutter shaft of the shredder. For example, the width of the arc-shaped pressing plate 106 can be between about ⅕ to about ⅓ of the length of the cutter shaft of the shredder. Furthermore, the arc-shaped pressing plate 106 can be set under the lower housing of the shredder 102 and, at the side, aligned with the cutter shaft of the shredder and close to the middle. That the width of the pressing plate is less than the length of the cutter shaft of the shredder enables the weight of the arc-shaped pressing plate to be reduced, easy to be pushed by the shredded paper waste piled inside the waste bin, leading to more sensitive detection. This also can decrease the probability of the pressing plate being damaged in the course of transportation. That the pressing plate is placed in the middle part enables the shredded paper waste filling in the waste bin to be more effectively and accurately detected.

Figure 9:
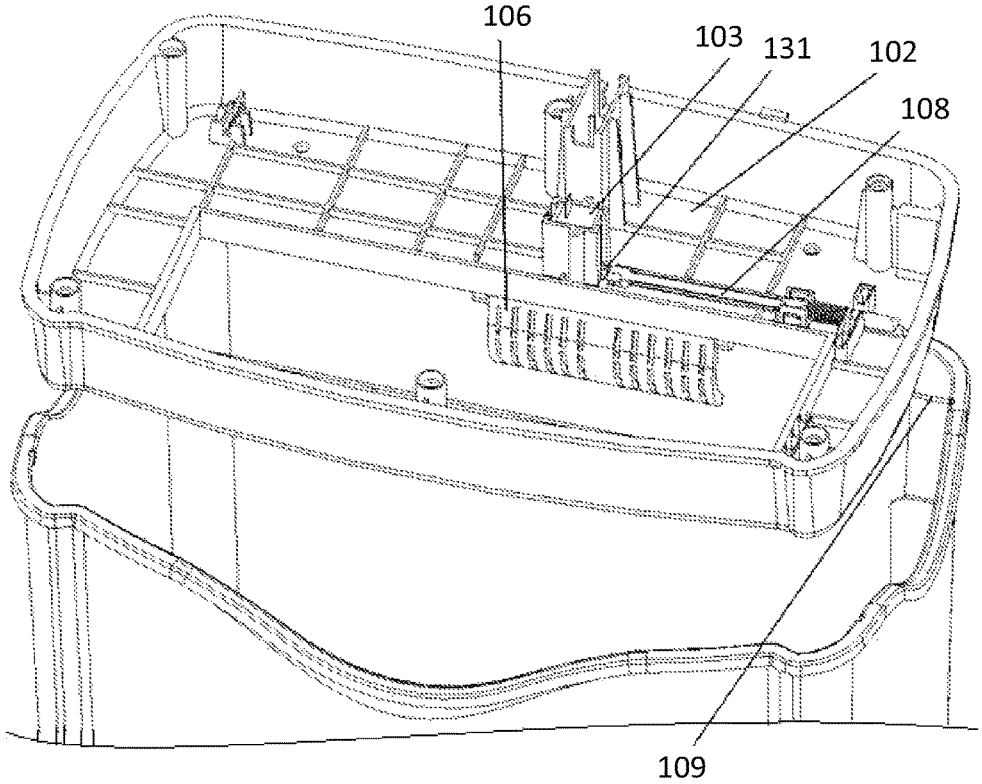
FIG. 9 is a perspective view drawing of the fourth embodiment of a shredder mechanical bin-full device, according to the teachings of the present invention.
Figure 10:
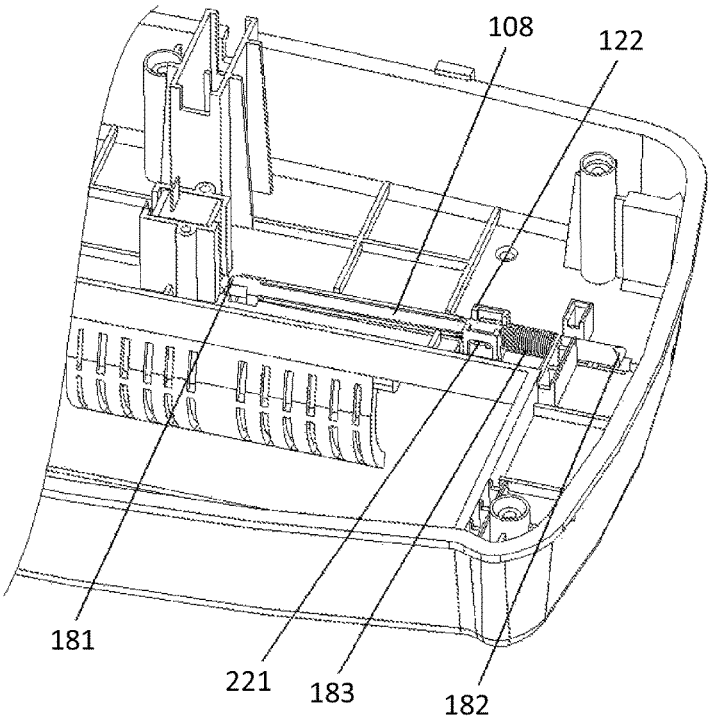
FIG. 10 is a perspective view drawing of the connecting rod and its connection relationship described in a fourth embodiment, according to the teachings of the present invention.
Figure 11:
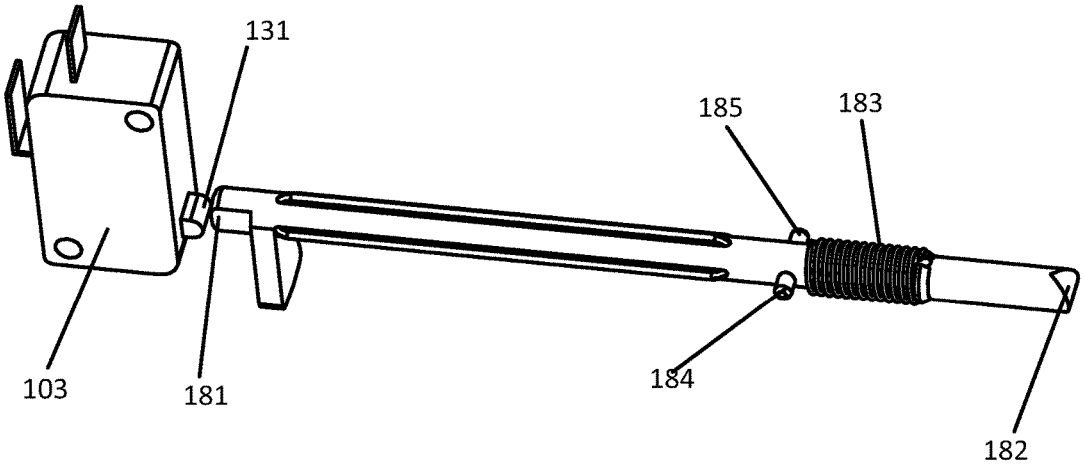
FIG. 11 is a perspective view drawing of the connecting rod and safety switch linkage as described in a fourth embodiment, according to the teachings of the present invention.

In this embodiment, the arc-shaped pressing plate 106 is configured with multiple holes. Also, as shown in FIG. 9, these holes may be evenly arranged. The setup of multiple holes can significantly reduce the weight of the arc-shaped pressing plate 106. The weight-reduction enables plate 106 to more easily to be pushed by the paper scrap gradually accumulating inside the waste bin, thus improving the sensitivity in terms of the paper-full detection. The configuration of evenly arranged holes with the same shapes can better contribute to processing and manufacturing.

In this embodiment, the principles that the shredder mechanical bin-full device is applied to achieve the power-off protection functions according to shredder head being lifted are explained as below: As shown in FIG. 5, when the shredder head is put into the waste bin, one end of the poke rod 104 just contacts the contact point 131 of the safety switch 103 which powers on the shredder to initiate operation. When the shredder head is lifted, one end of the poke rod 104 departs from the contact point 131 of the safety switch 103, powering off the shredder to terminate operation.

In this embodiment, the principle and process that the mechanical bin-full device applied to the shredder with the integral waste bin to achieve the paper-full detection function are described as below: As shown in FIG. 7 and FIG. 8, when the paper shredding starts, the quantity of the paper waste 107 is fairly small. Therefore, the arc-shaped pressing plate 106 is not pressed and the shredder remains in the power-on state to continue working (see FIG. 7). With the gradual increase of the paper waste 107 inside the waste bin, when the quantity of the paper waste 107 becomes enough to push the arc-shaped pressing plate 106, the arc-shaped pressing plate 106 will rotate around the axis of it and the lower housing of the shredder 102. When it rotates to a preselected angle, the tip part 611 of the touching sheet 161 on the arc-shaped pressing plate 106 will contact and push the poke rod 104, enabling it to rotate around the support 105, thus enabling the poke rod 104 to release the contact point 131 of the safety switch 103 (see FIG. 6). In such case, the shredder is powered off to cease operation, which reminds the user that the paper waste bin is full and that it is necessary to pour out the waste for the continuing work of the shredder. After the paper scraps are poured out, the poke rod 4 will go back to the original position because of gravity. Because of the limiting action of the limit bar 151 (FIG. 3), the poke rod 104 can just contact the contact point 131 of the safety switch 103 when the shredder head is put into the waste bin so that the shredder can be powered on to operation.

The mechanical bin-full device also can be used on the shredder with the drawing-type waste bin, realizing the functions of power-off protection of machine/waste bin separation and paper-full detection. The structure of poke rod 104 can be modified slightly with respect to such functions, as is described with respect to FIG. 7. There is a branch component disposed on the poke rod 104 through pivot connection, e.g. a branch rod 142, one end of which is connected to the poke rod 104 via pivoting and the other end is connected to the lower housing of the shredder through pivot connection. Under such structure, principle for power-off protection function of machine/waste bin separation is as follows: in FIG. 7, when the waste bin is drawn out, the poke rod 104, under the function of its own gravity, departs from the contact point 131 of the safety switch 103, and the shredder powers off. In FIG. 8, when the waste bin is pushed into the waste bin accommodation space below the shredder, the limit bar 151 which is set on support 105 of the waste bin pushes the vertical part 141 of the poke rod 104, enabling the poke rod 104 to turn along the shaft of the poke rod 104 and the branch rod 142 as well as along the shaft of the branch rod 142 and the lower housing of the shredder. This action enables the upper end of the poke rod 104 to touch the contact point 131 of the safety switch 103, therefore powering on the shredder. In this embodiment, the principle for realization of paper-full detection function by the mechanical bin-full device of shredder including the above-mentioned improvement structure of poke rod applied to the integral waste bin of the shredder is as follows: when paper waste is not full in the waste bin of the shredder, the mechanical bin-full device maintains the same state as that when the waste bin is pushed into the accommodation space under the shredder. When the paper waste increases and pushes the arc-shaped pressuring plate 106 to turn to push poke rod 104, and poke rod 104 turns along the pivot of it and the branch rod 142, therefore, enabling the upper end of the poke rod 104 to depart from contact point 131 of the safety switch 103 and the shredder power off. At this point, paper waste in the waste bin can be poured out, so that paper shredding and paper-full detection can be carried out again.

By carrying out of paper-full detection test on the above mentioned mechanical bin-full device of shredder, it has been demonstrated that the device possesses favorable paper-full detection function, together with the function of excellent power-off protection during machine/waste bin separation.

Example Embodiment 4

As shown in FIG. 7-10, the shredder in this embodiment includes the mechanical parts of the shredder (not shown in the Figures), the lower housing 102 of the shredder, as well as the mechanical bin-full device of shredder. As shown in FIG. 7, the mechanical bin-full device for the shredder of this embodiment mainly includes a contact switch, a touching device, and a pushing device. The contact switch, which is a safety switch 103 in this embodiment, may be fixedly installed on the lower housing 102 of the shredder. The safety switch 103 can be equipped with a contact point 131 that is contacted when the shredder starts normally, and operates. Upon the shredder head separating from the waste bin, the contact point 131 of the safety switch 103 is released, thus enabling the shredder to be powered off. Whether the contact point 131 is trigged or not is used by the safety switch 103 to control the power-on or power-off of the shredder;

The touching device, which is a connecting rod 108 in this embodiment, is connected to the lower housing 102 of the shredder, the connecting rod 108 is set with a first end 181 and a second end 182, and the second end 182 is set with a elastic component, which is a spring 183 in this embodiment. There is a bar set at the waste bin corresponding to the second end 182 of the connecting rod 108. Through spring 183, connecting rod 108 can contact the contact point 131 of the safety switch 103 as squeezed by the bar of corresponding position set on the waste bin of the shredder (see FIG. 8), in detail, the lower housing 102 of the shredder is set with fixed connecting rod holder 122 which limits the movement of connecting rod 108, the connecting rod holder 122 includes two identical parts which are set separately at both sides of the connecting rod 108, and each part is set with a long shaped slot, for example, kidney-shaped slot 221. The connecting rod 108 is set with two columnar convex elements 184 and 185 which are adaptable to the kidney-shaped slots 221 (see FIG. 10). The two columnar convex 184 and 185 are assembled inside of the two kidney-shaped slots 221 respectively and can slide along the kidney-shaped slots 221.

Moreover, this structure also may serve as revolving shaft, enabling the connecting rod 108 to turn along a direction perpendicular to the undersurface of the shredder lower housing within a small angle range. The connecting rod 108 is also set with restriction convex, and the spring 183 is sheathed on the connecting rod 108, for detail, one end of the spring 183 is resisted against the connecting rod holder 122 of the shredder lower housing, with the other end resisted against the restriction convex disposed on the connecting rod 108. Because the waste bin of the shredder is set with a bar 109 at the second end of the corresponding connecting rod 108, and the lower housing of the shredder is set with through holes at the corresponding positions of the bottom surface. When the shredder is put into the waste bin, the bar 109 can squeeze the second end 182 of the connecting rod 108 inward, thereby, pushing the first end 181 of the connecting rod 108 to contact the contact point 131 of the safety switch 103, enabling the shredder to power on, at the moment spring 183 is compressed. When lifting the lower housing 102 of the shredder, one end of the spring 183 is resisted against the connecting rod holder 122 on the lower housing of the shredder, while the other end pushes away the restriction convex on the connecting rod 108 via the resilience force, thereby, pushes away the connecting rod 108, enabling the first end 81 of the connecting rod 108 to depart from the contact point 131 of the safety switch 103, and then, the shredder is powered off. The abovementioned is the principle of mechanical bin-full device applied for the power-off protection function of machine/waste bin separation to the integral waste bin shredder of this embodiment. If it is applied to the shredder with the drawing-type waste bin, the bar may be set on the drawing-type waste bin, and through holes may be set at the positions corresponding to the lower housing sides of shredder. When pulling the drawing-type waste bin away, the bar on the drawing type waste bin releases the connecting rod 108, enabling the shredder to be powered off; when pushing in the drawing-type waste bin, the bar on the drawing type waste bin presses the connecting rod 108, thus pushing the first end 181 of the connecting rod 108 to contact the contact point 131 of the safety switch 103, enabling the shredder to power off. Besides, the lower part of the connecting rod 108 is set with a convex part 186. When pushing the convex part 186 upon paper full condition, the connecting rod 108 can turn a certain angle along the direction which is vertical to the lower housing of the shredder, enabling the first end 181 of connecting rod 108 to depart from the contact point 131 of the safety switch 103, achieving the effect of enabling the shredder to power off.

The pushing device, which can be an arc-shaped pressing plate 106, one end of which is pivotally installed through a rotation axis at the outer side of the mechanical parts of the shredder (not shown) under the lower housing 102 of the shredder, and the other end of which is the free end. The cambered surface of the arc-shaped pressing plate 106 backs on to the mechanical parts of the shredder (not shown), in which is equipped with a touching element, which is a touching sheet 161 in this embodiment. The touching sheet 161 is installed in the direction substantially perpendicular to the plate surface of the arc-shaped pressing plate 106, one end of which is connected to the plate surface of the arc-shaped pressing plate 106, and the other end of which has a tip part 611 that can push the convex part 186 of the connecting rod 108 when the shredded paper waste inside the shredder waste bin pushes the arc-shaped pressing plate 106 to rotate, enabling the convex part to depart from the contact point 131 of the safety switch 103.

In this embodiment, width of the arc-shaped pressing plate 106 is less than the length of the cutter shaft of the shredder. The typical width of the arc-shaped pressing plate 106 is between about ⅕ to about ⅓ of the length of the cutter shaft of the shredder. The arc-shaped pressing plate 106 is set under the lower housing 102 of the shredder where it is positioned at the side aligned with the cutter shaft of the shredder and close to the middle. In this embodiment, the arc-shaped pressing plate 106 typically is set slightly near the connecting rod 108. The arc-shaped pressing plate 106 is configured with several holes which can be waist type holes arranged evenly (see FIG. 2). The set of several holes may notably reduce the weight of the arc-shaped pressing plate 106, enabling it to be more easily pushed by the shredded paper waste which is gradually accumulated in the waste bin, improving its sensitivity to detect the filling state of waste paper.

Figure 12:
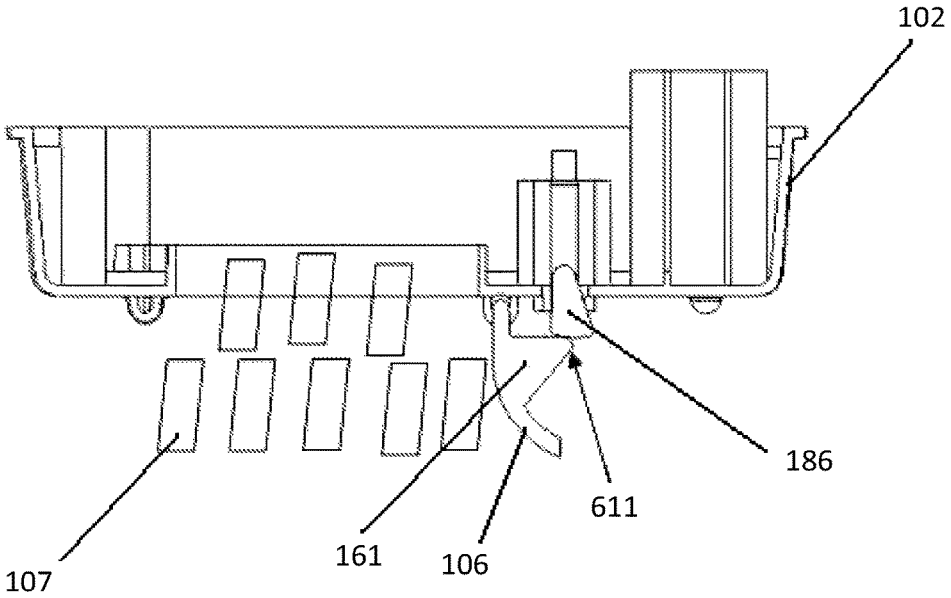
FIG. 12 is a cross-sectional drawing of the paper-full detection functions of the shredder mechanical bin-full device as described in a fourth embodiment, according to the teachings of the present invention.

The shredder mechanical bin-full device is set on the lower housing 102 of the shredder, therefore, operating principles for it to be used on the shredder with the integral waste bin and shredder with the drawing-type waste bin are similar. The specific principle and process are that: (see FIG. 12, FIG. 13A and FIG. 13B), when the paper shredding just starts, the volume of paper waste 107 is small, therefore, arc-shaped pressing plate 106 is not pressed, the shredder maintains the power-on status and operates continuously. With the gradually increasing of paper waste 107 in the shredder, when the paper waste reaches certain volume, it touches the arc-shaped pressing plate 106. The arc-shaped pressing plate 106 rotates around the shaft of the plate 106 and the lower housing 102 of the shredder, enabling the top part 611 of the touching sheet 61 to contact the convex part 86 of the connecting rod 108 (see FIG. 10). With the gradual increasing of the paper waste 107, it gradually pushes the arc-shaped pressing plate 106 to revolve, and the top part 611 of the touching sheet 161 of the arc-shaped pressing plate 106 lifts up the convex part 186 of the connecting rod 108 (see FIG. 13A), enabling it to revolve upward and depart from the contact point 131 of the safety switch 103 (see FIG. 13B), upon which the shredder is powered off and shuts down. The user is alerted that the paper waste is full and the shredder can only go on working when the paper scrap is poured out. When the paper waste is poured out, and the waste bin is pushed in or placed to its original place, the first end 181 of the connecting rod 108 contacts the contact point 131 of the safety switch 103 to proceed to the next paper shredding circulation.

Figure 13A:
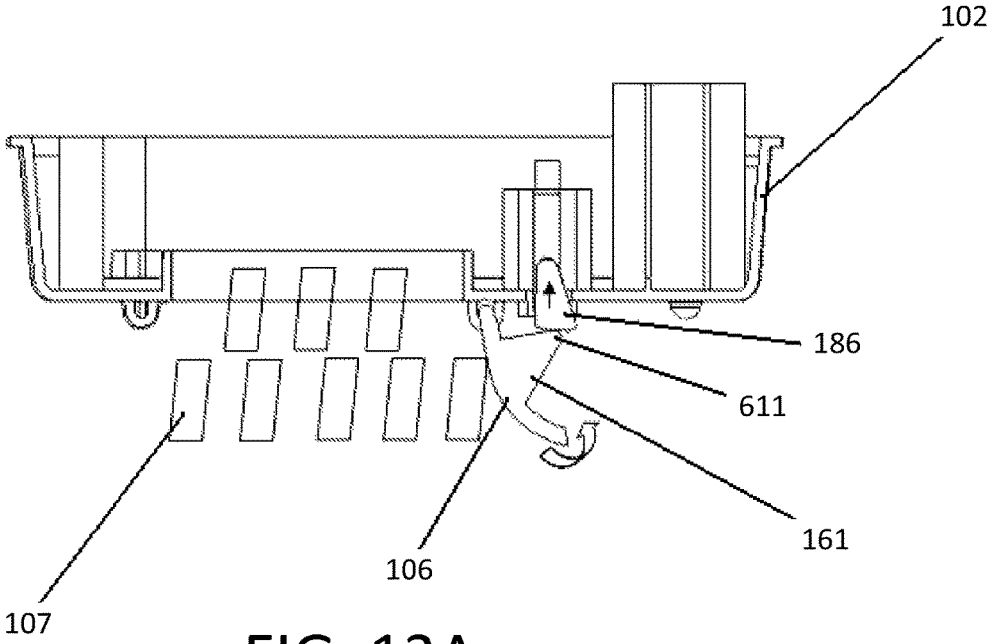
FIG. 13A and FIG. 13B are cross-sectional drawings of the paper-full detection functions of the shredder mechanical bin-full device of the fourth embodiment, in accordance with the teachings of the present invention.
Figure 13B:
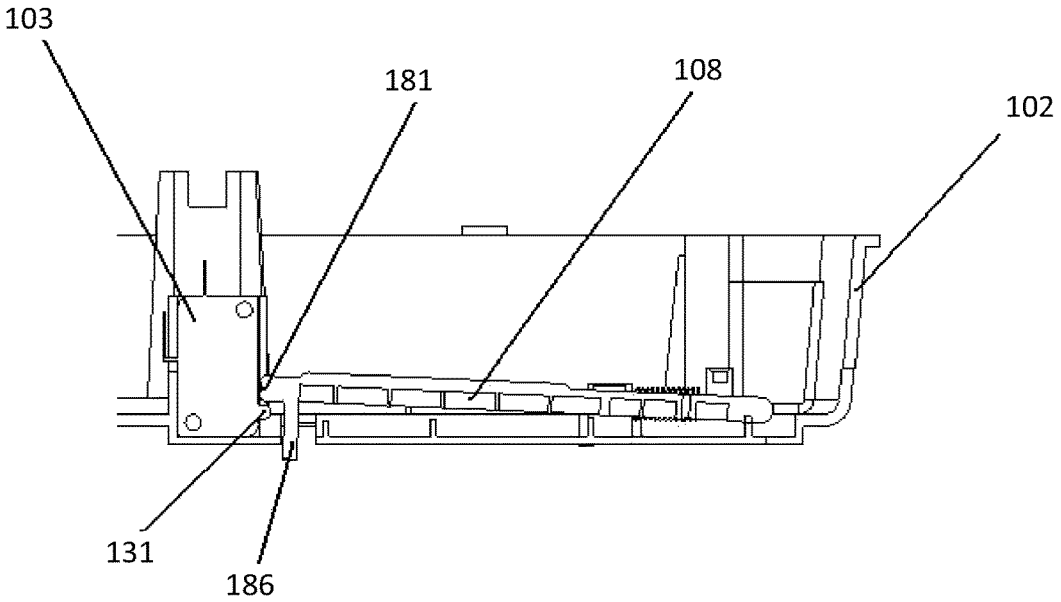

FIG. 13A and FIG. 13B are drawings based on the application processes of the paper-full detection functions by the mechanical bin-full device of shredder as described in the fourth embodiment, which respectively shows the conditions of the safety switch and connecting rod from different perspectives when the shredder is powered off.

All the components of the mechanical bin-full device for the shredder of this embodiment are set on the lower housing of the shredder, with a wider range of shredder model applicable and not limited by the set mode of the waste bin of the shredder.

Example Embodiment 5

Figure 14:
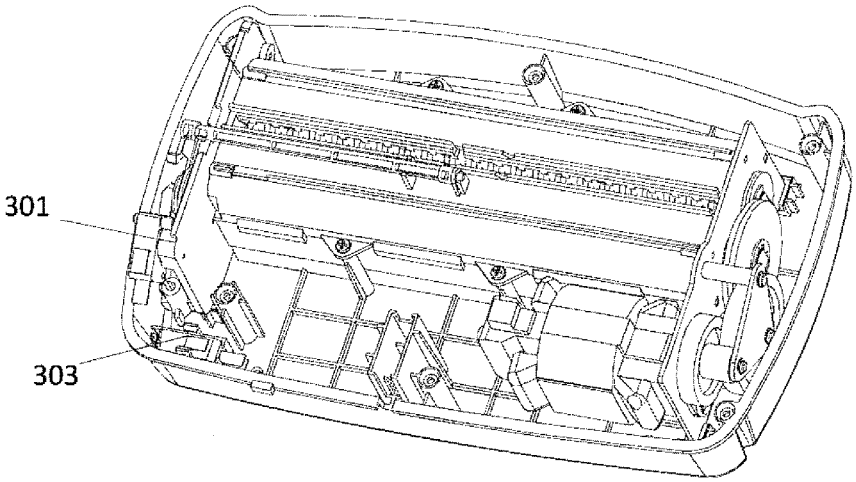
FIG. 14 is a perspective view drawing for the time-delay switch and the safety switch of the shredder in the prior art.

Turning to FIG. 14, a prior art shredder head is shown including separate time-delay switch 301 and safety switch 303 is shown. Requiring separate elements for the time delay switch and safety switch can increase costs and decrease reliability. The embodiments of the present invention provide for an integrated time-delay and safety switch.

Figure 15:
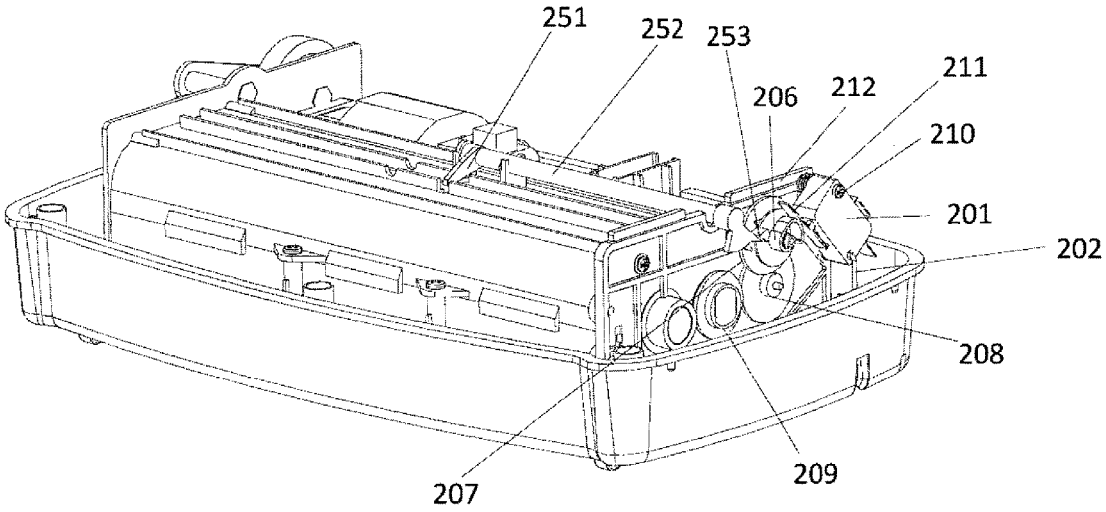
FIG. 15 is a perspective view of the time-delay mechanism of shredder integrated with a safety switch in an embodiment, according to teachings of the present invention.
Figure 16:
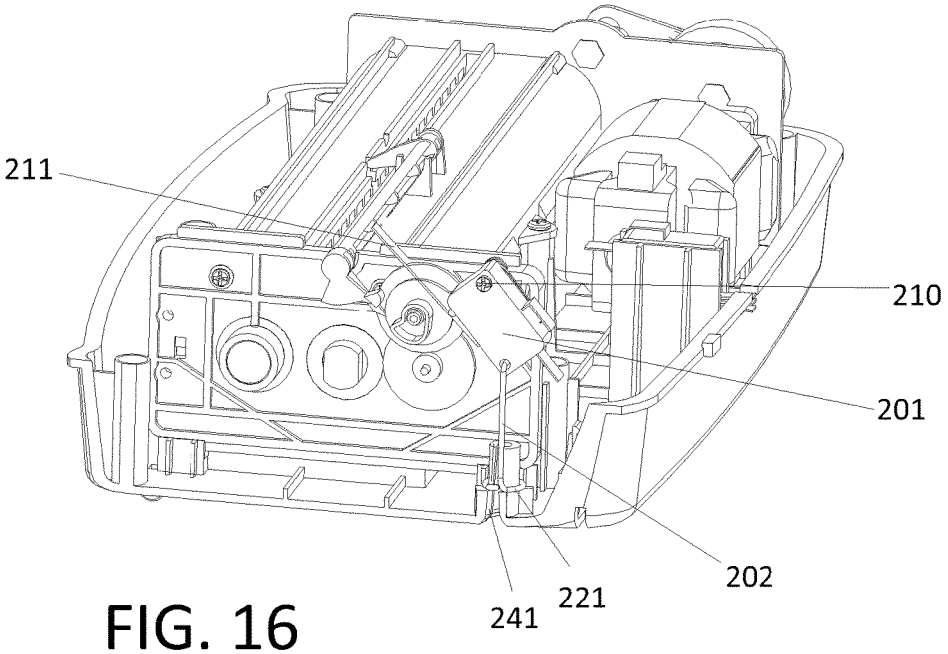
FIG. 16 is a perspective view of the time-delay mechanism embodiment when the shredder head deviates from the paper waste bin, according to teachings of the present invention.
Figure 17:
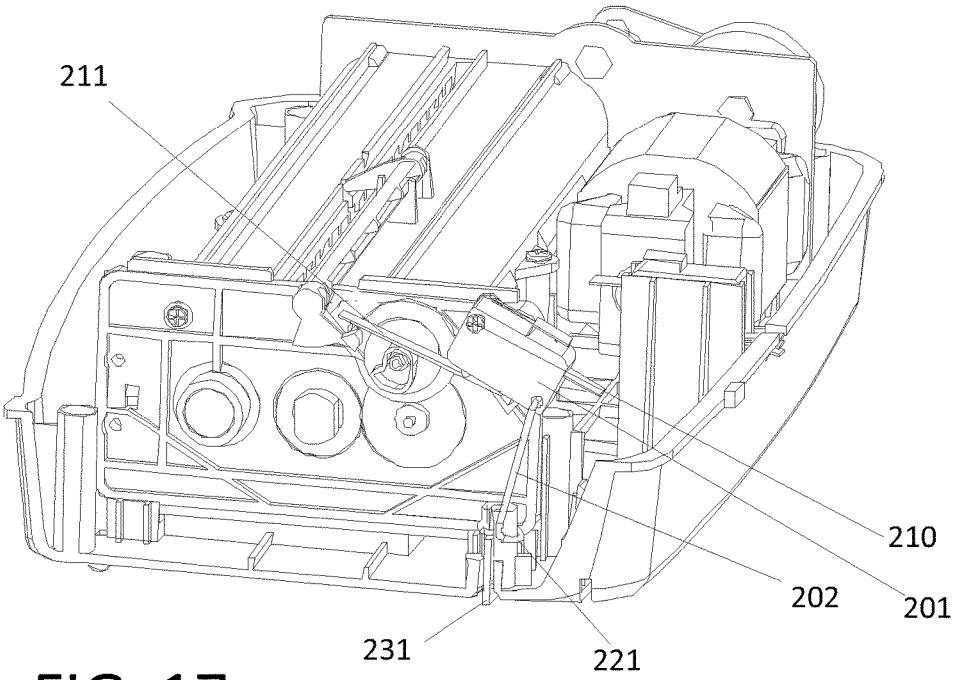
FIG. 17 is a perspective view drawing for parts of the time-delay mechanism of the embodiment of this invention after the shredder head is put into the paper waste bin, according to teachings of the present invention.

Referring to FIGS. 15 and 16, in this embodiment, the time-delay mechanism of shredder integrated with a safety switch of power-off function according to the lifted position of the shredder head, includes a time-delay switch body 201, which is pivot-connected to the side plate 212 of the shredder through a connecting pivot 210. The time-delay switch body 201 is provided with a forced rod 202. The paper waste bin of the shredder is provided with a support rib 231 (not shown in FIG. 15, see FIGS. 17-21) at the location corresponding to the forced rod 202. One end of the forced rod 202 is connected to the time-delay switch body 201 through pivoting connection and the other end is connected to the support rib 231 (not shown in FIG. 15, see FIGS. 17-21) by means of touch. When the shredder head is put into the paper waste bin, under the driving of the support rib 231, the forced rod 202 can drive the time-delay switch body 201 to rotate and leave it in contact state with the paper entrance. In this embodiment, the time-delay switch body 201 includes a contact piece 211, which rotates and joins to the time-delay switch body 201 and makes the time-delay switch body 201 closed, and the contact piece 211 revolves and deviates from the time-delay switch body 201 and makes it open. The forced rod 202 is provided with a ring-like assembly 221 (not shown in FIG. 15, see FIGS. 16-17) at one end where it is connected to the support rib 231 by means of touch. The ring-like assembly 221 (not shown in FIG. 15, see FIGS. 16-17) is installed on a hollow cylinder 241 (not shown in FIG. 15, see FIG. 16) set at the lower housing of the shredder and its tail end stretches into the cavity of the hollow cylinder 241 (not shown in FIG. 15, see FIG. 16). The above installation mode of the tail end of the forced rod which is connected to the support rib by means of touch and the lower housing of the shredder is only an example. Any suitable structure in which the support rib on the paper waste bin of the shredder can lift up the forced rod and then make the time-delay switch body 201 rotates and keep in the contact state in case of paper entering is within the scope of this invention.

In this embodiment, the time-delay mechanism of shredder integrated with a safety switch typically includes a contact component with the paper entrance, which includes a contact part 251 at paper inlet, a connecting rod 252 and a push button 253. Two ends of the connecting rod 252 are fixed respectively to the contact part 251 at paper inlet and the push button 253, and the push button 253 can drive the time-delay switch body 201 during entering of paper and make it closed.

The time-delay mechanism also typically includes a time-delay component, which includes a cam 206 and a gear 207.

The cam 206 and the gear 207 generally rotate synchronously in the same direction, and the gear 207 is engaged with the cutter shaft gear 209 of the shredder through a reduction gear 208.

Figure 18:
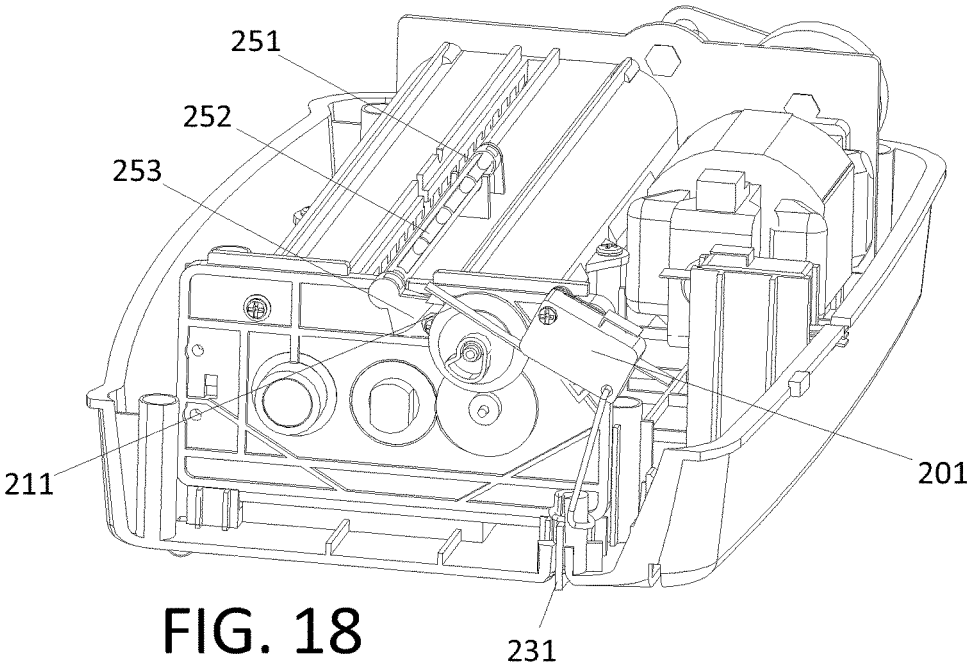
FIG. 18 is a perspective view drawing for parts of the time-delay mechanism of the embodiment of this invention during paper entry, according to teachings of the present invention.
Figure 19:
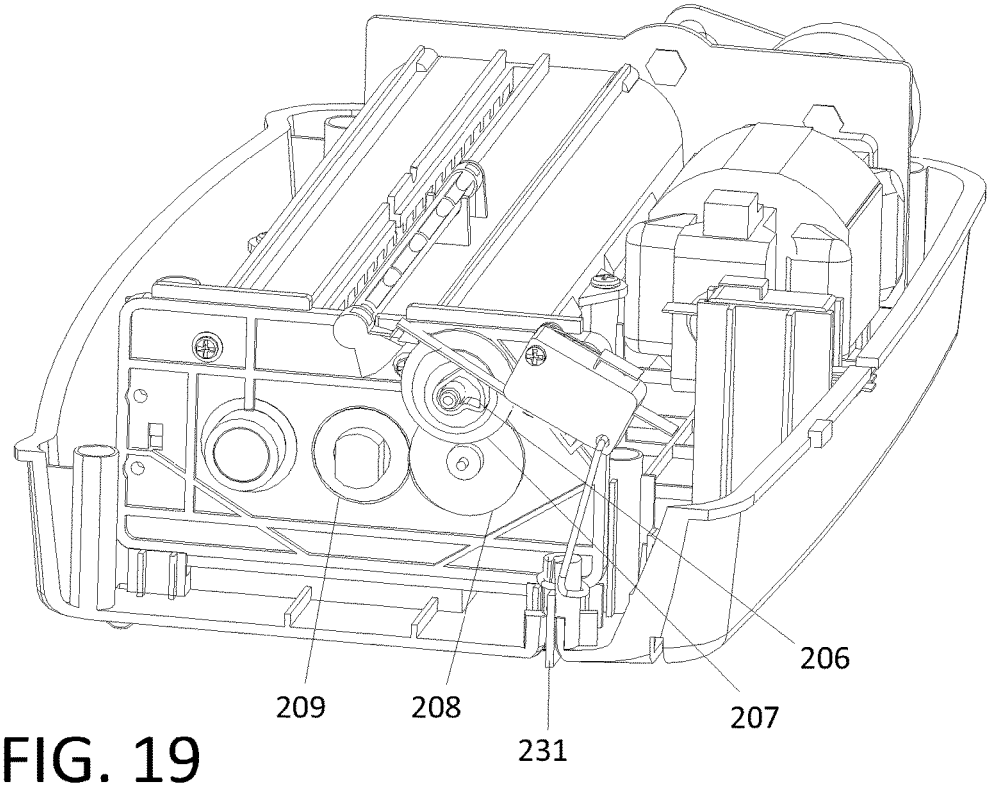
FIG. 19 is a perspective view drawing for revolution of the time-delay mechanism in the paper shredding process in the embodiment, according to teachings of the present invention.
Figure 20:
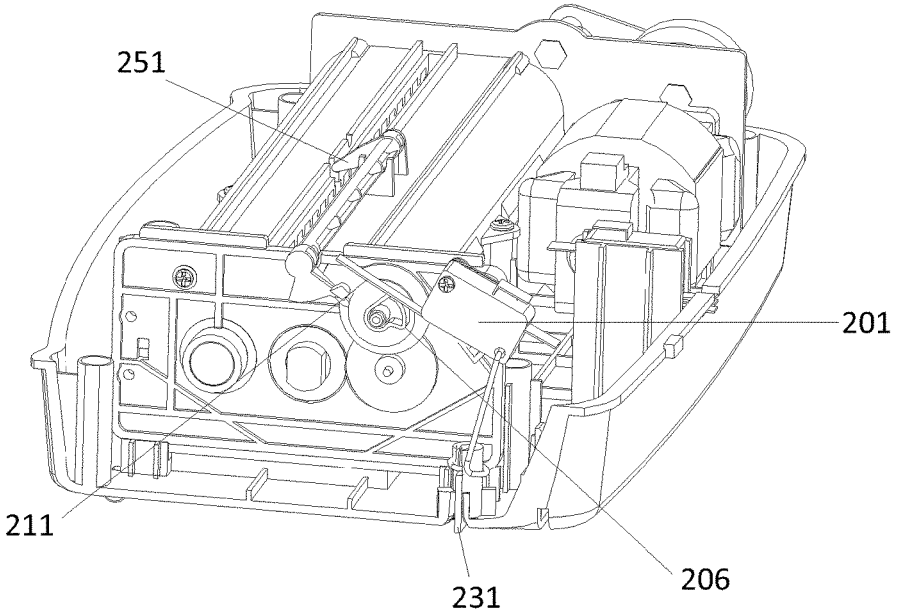
FIG. 20 is a perspective view drawing for parts of the time-delay mechanism of the embodiment of this invention when the paper fully enters into the shredder and the contact part returns and delays, according to teachings of the present invention.
Figure 21:
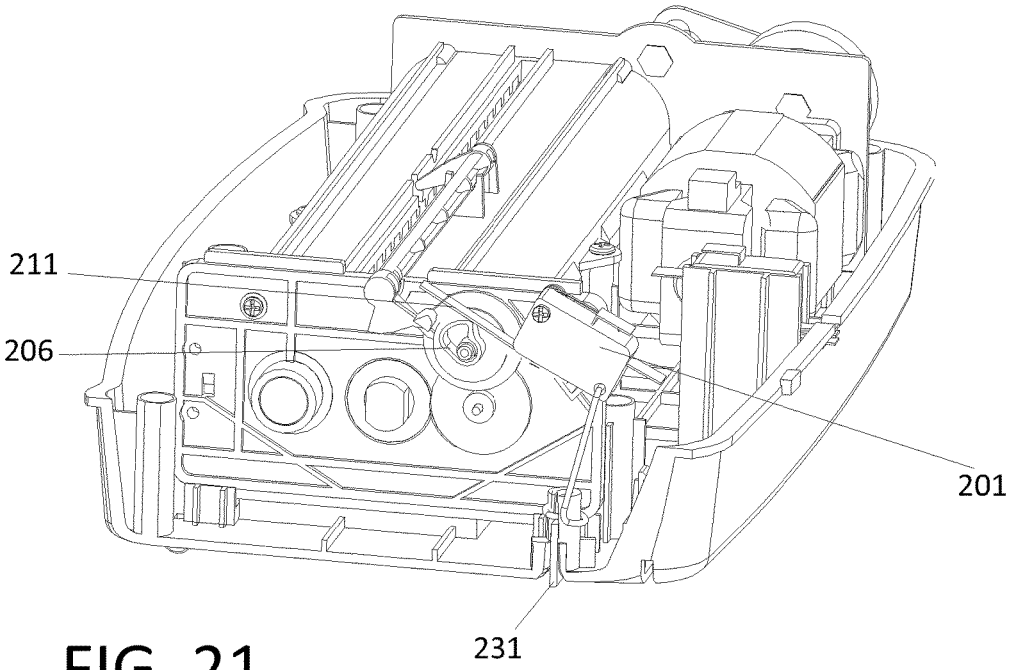
FIG. 21 is a perspective view drawing of the time-delay mechanism of the embodiment of this invention when the time-delay switch body disconnects following the end of time delay, according to teachings of the present invention.

The working principle and process for the time-delay mechanism of shredder integrated with a safety switch of this embodiment are as follows: referring to FIG. 16, when the shredder head deviates from the paper waste bin, the forced rod 202 is not driven by the support rib 231 (not shown in FIG. 16, see FIGS. 17-21). The time-delay switch body 201 revolves downwards along the connecting shaft 210 due to its gravity and makes the contact piece 211 on it depart from the time-delay switch body 201, making the time-delay switch body 201 open, and then the shredder is powered off. When the shredder head is put into the paper waste bin, the tail end 221 of the forced rod 202 is lifted up by the support rib 231 on the paper waste bin and makes the forced rod 202 uplift. Under the upward pushing force, the time-delay switch body 201 revolves to a preselected angle around the connecting shaft 10, which makes the time-delay switch body 201 achieve the deflection angle at which the shredder does not shred any paper in the normal state, i.e. the contact state when is paper entering, as shown in FIG. 7. When there is paper put at the paper inlet, the contact part 251 at paper inlet is depressed by the paper and makes the push button 253 revolve upwards through the connecting rod 252. This action drives the contact piece 211 of the time-delay switch body 201 and makes it rotate and joint to the time-delay switch body 201, thus making the time-delay switch body 201 closed. Then, the shredder is powered on and begins the paper shredding, as shown in FIG. 18. In the paper shredding process, the time-delay component (the cam 206 and the gear 207 revolving in the same direction) turns with the rotation of the cutter shaft of the shredder under the driving action of the shredder cutter shaft gear 209 and the reduction gear 208, as shown in FIG. 19. When the paper fully enters into the mechanical part of the shredder, the contact part 251 at paper inlet bounces and begins the time delay. The cam 206 of the time-delay mechanism of the shredder resists the contact piece 211 of the time-delay switch body 201, and so the shredder remains powered on and its cutter shaft continues to revolve, thus the cam 206 revolves as well, as shown in FIG. 20. The contact piece 211 leaves the time-delay switch body 201 due to its gravity and makes the time-delay switch body 201 open, until the cam 206 revolves to departing from the contact piece 211 of the time-delay switch body 201 and cannot resist the contact piece 211, ending the time delay, as shown in FIG. 21. The shredder now is powered off.

Through the installation of a forced rod, these embodiments uses one switch to achieve not only the power-off function according to the lift of the shredder head but also the contact function when paper entering, and also ensure the time-delay effect in paper shredding. It is easy for use with high efficiency and saves cost as well.

Except for the above mode of execution, the idea that the time-delay switch of shredder integrated with a safety switch installed on the forced rod which is linked with the shredder's paper waste bin is also applied to any suitable time-delay mechanism with contact function when paper entering; the above embodiments are only used for illustrating the contents of this invention; except for the above mode of execution, this invention has other modes of execution; all technical protocols formed in the mode of equal replacement or equivalent transformation are within the scope of protection of this invention.

The example embodiments of the present invention disclosed herein are intended to be illustrative only, and are not intended to limit the scope of the invention. It should be understood by those skilled in the art that various modifications and adaptations of the prevent invention as well as alternative embodiments of the prevent invention may be contemplated or foreseeable. It is to be understood that the present invention is not limited to the sole embodiments described above, but encompasses any and all embodiments within the scope of the following claims.

What is claimed is:

1. A mechanical bin-full device of a paper shredder with a lower housing, mechanical parts, and a waste bin, comprising:

a contact switch with a contact point, wherein the contact switch is provided on the lower housing of the shredder, and the contact point is contacted when the shredder head is put into the waste bin so that the shredder is permitted to be powered on, and the contact point is released provided that the shredder head separates from the waste bin, enabling the shredder to be powered off;

a touching device, installed on the lower housing of the shredder or the waste bin that can touch or depart from the contact point of the contact switch, thus enabling the shredder to be powered on or powered off, respectively; and a pushing device, one end of which is pivotally installed under the lower housing of the shredder outside any engagement with the mechanical parts of the shredder, and the other end of which is a free end, the pushing device can push the touching device while being pushed by paper waste in the shredder waste bin, enabling the touching device to depart from the contact point of the contact switch.

2. The mechanical bin-full device of paper shredder of claim 1, wherein the pushing device is a pressing plate, on which a touching element is provided, wherein the touching element can push the touching device while paper waste in the shredder waste bin pushes the pressing plate to rotate, enabling the touching device to depart from the contact point of the contact switch.

3. The mechanical bin-full device of paper shredder of claim 2, wherein the pressing plate is an arc-shaped pressing plate, the cambered surface of which backs to the mechanical parts of the shredder, and the touching element is set inside the cambered surface of the arc-shaped pressing plate.

4. The mechanical bin-full device of paper shredder of claim 3, wherein the touching element is a touching sheet, one end of which is connected to the plate surface of the arc-shaped pressing plate, and the other end of which has a tip part that can push the touching device so that the touching device can depart from the contact point of the contact switch.

5. The mechanical bin-full device of paper shredder of claim 4, wherein the touching sheet is installed in the direction perpendicular to the plate surface of the arc-shaped pressing plate.

6. The mechanical bin-full device of paper shredder of claim 2, wherein the width of the pressing plate is less than the length of the cutter shaft of the shredder.

7. The mechanical bin-full device of paper shredder of claim 2, wherein the pressing plate has multiple holes.

8. The mechanical bin-full device of paper shredder of claim 3, wherein the width of the pressing plate is less than the length of the cutter shaft of the shredder.

9. The mechanical bin-full device of paper shredder of claim 3, wherein the pressing plate has multiple holes.

10. The mechanical bin-full device of paper shredder of claim 2, wherein the touching device is a poke rod that is installed by a support at the inner side of the shredder waste bin, the poke rod is pivotally connected to the support that is fixed to the shredder waste bin; the support is set with a first restriction member that ensures the poke rod to contact the contact point of the contact switch in the case that the shredder head is put into the waste bin.

11. The mechanical bin-full device of paper shredder of claim 10, wherein the first restriction member is a limit bar that is transversely installed on the support; the poke rod has a vertical part, one side surface of which is prop up one end of the limit bar, the relative position of the limit bar and the vertical part is set to ensure the poke rod to contact the contact point of the contact switch in the case that the shredder head is put into the waste bin.

12. The mechanical bin-full device of paper shredder of claim 11, wherein the support is equipped with a second restriction member that is used for restricting the moving distance of the poke rod upon being pushed by the touching element of the pressing plate.

13. The mechanical bin-full device of paper shredder of claim 12, wherein the second restriction member is a limit bar and is set to be parallel to the first restriction member.

14. The mechanical bin-full device of paper shredder of claim 2, wherein the touching device is a poke rod which is installed on the lower housing of the shredder through axially connecting to a branch component that is pivotally connected to the lower housing of the shredder, the inner side of the shredder waste bin is set with a support that can prop up one end of the poke rod when the drawing-type waste bin of the shredder is pushed in, thus enabling it rotate to contact the contact point of the contact switch.

15. The mechanical bin-full device of paper shredder of claim 14, wherein the support is set with a first restriction member that can prop up one end of the poke rod when the drawing-type waste bin of the shredder is pushed in, thus enabling the support rotate to contact the contact point of the contact switch.

16. The mechanical bin-full device of paper shredder of claim 15, wherein the support is equipped with a second restriction member that is used for restricting the moving distance of the poke rod upon being pushed by the touching element of the pressing plate.

17. The mechanical bin-full device of paper shredder of claim 16, wherein the connecting rod holder includes two identical components located correspondingly to the both sides of the connecting rod, the long shaped slot is respectively set on the two components.

18. The mechanical bin-full device of paper shredder of claim 1, wherein the touching device is a connecting rod connected to the lower housing of the shredder and can move forward and backward, the connecting rod is set with a first end and a second end, wherein the second end is equipped with an elastic element, the shredder waste bin is set with bars in the place corresponding to the position of the second end of the connecting rod, this elastic element enables the connecting rod to contact the contact point of the contact switch in the pushing of the bars set on the shredder waste bin; and further comprising:

a convex part disposed under the connecting rod, which can be pushed by the pushing device when it is pushed by the paper waste inside the shredder waste bin, thus enabling the first end of the connecting rod to depart from the contact point of the contact switch.

19. The mechanical bin-full device of paper shredder of claim 18, wherein the lower housing of the shredder is disposed with a connecting rod holder, the connecting rod passes through the connecting rod holder, which has two long shaped slots correspondingly to the both sides of the connecting rod, according to the long shaped slots, the connecting rod is set with two columnar convex that could be respectively set in each long shaped slot and can slide in it.

20. The mechanical bin-full device of paper shredder of claim 18, wherein the connecting rod is set with restriction convex, the elastic element is a spring, one end of which props up the connecting rod holder and the other end of which props up the restriction convex.

* * * * *